US006260783B1

(12) United States Patent
Realff et al.

(10) Patent No.: US 6,260,783 B1
(45) Date of Patent: Jul. 17, 2001

(54) AUTOMATED YARN CREELING DEVICE

(75) Inventors: Mary Lynn Realff, Atlanta, GA (US); Robert Braga, Billerica, MA (US); David Burrows, Hanscom AFB, MA (US); Eric Fuller, Macon, GA (US); Erika Geist, Peoria, IL (US); Courtenay Glanville, Atlanta, GA (US); Wiley Holcombe; Harvey Lipkin, both of Decatur, GA (US); Gary McMurray, Atlanta, GA (US); Mark Sagers, Cordova, TN (US); Bernie Ulmer, Lawrenceville; Youjiang Wang, Atlanta, both of GA (US)

(73) Assignee: Georgia Tech Research Corp., Atlanta, GA (US)

( * ) Notice: Subject to any disclaimer, the term of this patent is extended or adjusted under 35 U.S.C. 154(b) by 0 days.

(21) Appl. No.: 09/243,246

(22) Filed: Feb. 3, 1999

Related U.S. Application Data

(60) Provisional application No. 60/073,521, filed on Feb. 3, 1998.

(51) Int. Cl.[7] ..... B65H 49/00

(52) U.S. Cl. ..... 242/474; 242/559; 414/21; 414/222.07; 294/98.1

(58) Field of Search ..... 242/474, 470, 242/558, 559; 414/21, 222.02, 222.07, 222.08; 294/98.1; 57/281; 901/45

(56) References Cited

U.S. PATENT DOCUMENTS 3,714,770 * 2/1973 Rothke ..... 294/98.1 X
3,809,257 * 5/1974 Klancnik ..... 414/222.07
3,835,633 * 9/1974 Klein ..... 294/98.1 X
3,895,482 * 7/1975 Schulz et al. ..... 294/98.1 X
4,132,318 * 1/1979 Wang et al. ..... 414/21 X
4,532,759 * 8/1985 Bischofberger ..... 57/281 X
4,821,504 * 4/1989 Shinkai et al. ..... 242/474 X
4,945,979 * 8/1990 Cullen et al. ..... 901/45 X
4,988,252 * 1/1991 Yamamoto et al. ..... 242/474 X
4,998,857 * 3/1991 Paravella et al. ..... 414/21 X
5,031,304 * 7/1991 Shepard et al. ..... 901/45 X
5,052,736 * 10/1991 Loncaric et al. ..... 901/45 X
5,100,073 * 3/1992 Moerke et al. ..... 57/281 X
5,396,714 * 3/1995 Sturges, Jr. et al. ..... 901/45 X
5,398,878 * 3/1995 Mohrke ..... 242/470
5,423,493 * 6/1995 Rueth et al. ..... 57/281
5,575,142 * 11/1996 Munnekehoff ..... 57/281
5,797,557 * 8/1998 Wang et al. ..... 242/559 X
5,979,817 * 11/1999 Kim ..... 242/474 X

OTHER PUBLICATIONS

D.E. Whitney and J.L. Nevins, "What is the Remote Center Compliance (RCC) and What Can It Do?", The Charles Stark Draper Laboratory, Inc. (USA), 9th ISIR, pp., 135–152.

"Automated Yarn Creeling For the Fabric and Carpet Industry" Project No.: GIT/AYC/1/FY96, Final Technical Report, Fiscal Year 1996, pp. 1–27.

* cited by examiner

*Primary Examiner*—Donald P. Walsh
*Assistant Examiner*—Minh-Chau Pham
(74) *Attorney, Agent, or Firm*—Todd Deveau; Ryan A. Schneider; Troutman Sanders LLP

(57) ABSTRACT

An automated yarn creeling method and apparatus for the textile industry. Preferably, the present yarn creeling system is used in the carpet tufting industry to automate, ultimately, the intelligent transfer of packages of yarn from the shipping pallets to the bullhorns of a creeler. The apparatus preferably comprises a service arm assembly, a vertical support, a base support, and automated weighing and control systems.

19 Claims, 8 Drawing Sheets

TIME LINE FOR CREELING ROBOT

AUTOMATED YARN CREELING DEVICE

CROSS-REFERENCE TO RELATED APPLICATIONS

This application claims the benefit under 35 U.S.C. §119 (e) of prior U.S. Provisional application Ser. No. 60/073,521 filed Feb. 3, 1998.

BACKGROUND OF THE INVENTION

1. Field of the Invention

The present invention relates generally to a computer controlled creeling device for use in the carpet and textile industries, which device can intelligently move items in and around the manufacturing floor, and place bobbins where needed. Preferably, the device is an automated yarn creeling system for carpet tufting. The creeling device ultimately transfers packages of yarn from shipping pallets to the bullhorns of a creeler. The device determines the locations of empty packages, removes the empty packages and discards the empty cores, picks up and weighs full packages, and places the full packages on the empty bullhorn.

2. Background

A creel is a large rack or set of racks that holds several hundred spools or packages of yarn. Presently in the carpet and textile industries an individual, the creeler, is responsible for both the continuous running of the tufting machine, and most importantly, the replacement of empty packages on the creel with full packages. Packages are "skewered" through a central core in the package, wherein the core is typically a cardboard cylinder.

Carpet tufting plants typically use magazine-style creels. Each tufting machine creel has twice has many packages as needles or ends. A typical plant uses expanded creels that have both loading aisles and tying aisles. The creels have a set of rollers down the center of the loading aisles to move the shipping pallets, or full cases, of yarn packages. The creels are generally only two levels high.

No known automatic creeling system yet exists for the carpet tufting industry. Yet, an automated creeling device would improve the carpet manufacturing process by reducing the creel set-up time and cost, as well as decreasing the work-related injuries and waste produced by the current, manual system. Further, an automated creeling device would increase overall efficiency and improve the product quality, machine efficiency and the working conditions for the production workers involved in this process.

The job of creeling involves manually lifting full yarn packages (each weighing approximately 13 pounds) and placing them on the creel's bullhorns. Labor costs for performing this and related tasks can be quite high. Related tasks are, for example, finding and removing empty bobbins, replacing them with full packages of yarn, tying knots between the tail ends of running packages and the starting ends of the packages. In one carpet manufacturing plant, approximately 92 packages must be replaced every hour on a typical carpet tufting machine (that is, one every 39 seconds). In some instances, the creeler must lift the full packages as high as above his/her head while working on the creel. Therefore, a creeler may fully lift approximately 800 pounds of yarn per hour. This repeated motion can lead to work-related injuries, including metacarpal syndrome, and to high employment turnover rate. The automation of the creeling process would virtually eliminate this type of injury, among others, and its associated cost. Further disadvantages with the present job of creeling are the repetitive operation and servicing of the present creel system, which can lead to employee loss of interest and errors.

The textile industry has indicated that the level of efficiency during the third shift typically is lower than during the first and second shifts. Operator errors lead to lower quality goods and/or slower overall production rates. An automated creeler would run with the same efficiency 24 hours per day, and, thus, the level of efficiency would not depend nearly as much on the supply and quality of labor during shifts, especially the third shift.

Further, because yarn packages contain different lengths of yarns, the tufting creel may contain packages ranging from empty to near full, requiring a costly cut back operation to average the yarns among all packages, or downgrading the leftover yarns for lower grade carpet. An automated system should be capable of weighing and replacing individual packages to intelligently match lighter packages with heavier ones such that all the packages run out at approximately the same time at the conclusion of a yarn lot.

For simplification of description, there are generally four modes of operation in the creeling process: (1) normal operation; (2) changeover operation (used when changing to a new lot of yarn and removing all of the previous packages); (3) cut back operation (used when changing to a new lot of yarn without removing all of the previous packages); and (4) blow back operation (used when an end breaks).

In the normal operation of the creel, the individual creeler identifies empty packages on the bullhorns, manually removes and discards the empty packages, selects and places new packages on the bullhorns, and ties in each new package.

In the changeover operation, the creeler locates empty packages, replaces them with full packages from a new lot, and ties the leading yarn end of the new package to the trailing end of the package running on the opposite bullhorn.

The cut back operation involves a redistribution of packages that remain on the creel at the end of a lot and placing packages of the new lot yarn on the creel. This process allows the "easing in" of the new lot of yarn. The carpet that is made during this transition can be dyed light colors with little or no negative effect on the end product. Currently, the cut back operation requires approximately 15 man-hours to complete. During this time, the tufting machine is not running. There is also a backwinding process that is performed to make larger packages from the small packages left on the creel.

Finally, the blow back operation is necessary when a yarn breaks somewhere near the tufting machine or in the tube guiding the yarn. It involves blowing a yarn end from the tufting machine to the yarn package on the creel and tying it in.

3. Technical Approach

The carpet industry has indicated a need for the creeling operation to be automated to improve the efficiency and eliminate the job-related injuries associated with the present, manual creeling operation. To augment the initial designing of the present invention, two issues were studied. First, a method called 'Matching' was developed and studied as a method to both reduce the amount of leftover yarns (residual yarns) at the end of a lot of carpet tufting and eliminate the cut back operation. Implementation of this method found that the inefficiencies in the creeling operation were greatly reduced. It was also found that this method could be implemented on the current creeling process performed by human workers, if proper personnel selection and careful job training were executed.

Second, the physical parameters and the servicing policies of the automated creeling device of the present invention were identified and determined through simulation studies. From those results, the design requirements of the present invention were specified.

Study of the placement of yarn packages and how they are replaced on the creel has indicated that the cut back operation can be eliminated or at least shortened with proper control over the placement of yarn. This type of controlled placement is implemented and monitored by the automated system of the present invention. This leads to time savings as well as reduction of waste.

The present invention automates the yarn package handling portion of the above modes of operation. Individuals are necessary for the tying step, which currently still must be completed manually. Therefore, with creeling automation, the following costs, among others, will be reduced or eliminated: labor, tufting machine down-time, health and injury related costs, yarn waste at the end of a yarn lot, operator errors, and operating training.

It should be noted that the creeling operation for the warping process in fabric manufacturing faces similar inefficiencies. Whereas in the carpet tufting process several yarns are fed from a creel to a tufting machine, in the warping process several yarns are fed from a creel to a large spool or beam. The yarns are wrapped around the beam parallel to each other. Eventually the yarns are fed off of the beam into a weaving loom. Thus, the creeling automation method and device disclosed herein can be extended to serve the textile industry as well.

To eliminate the cut back operation, the variation in package run-out times at each bullhorn was reduced. One way this was achieved was by manipulating the placement of packages so that the difference in the amount of yarn processed at each bullhorn pair was minimized. Since the weight deviation from package to package could not be controlled, it was compensated for at each pair of bullhorns by intelligently placing the packages so that the total package weight variation for each bullhorn pair was reduced. This was achieved by matching the package weights so that if the package that was currently running on one bullhorn was a "heavy" one, then a "light" package would be placed on the opposite bullhorn. By matching the package weights, the total sum of the weights of both packages was close to twice the average package weight. Obviously, these descriptive categories such as "heavy" were quantified in the simulation studies that determined the performance requirements of the present invention.

As the tufting machine took up yarn, the first set of packages placed ran out at widely varying times, but the second set of packages ran out at roughly the same time. The matching of the second set of package weights reduced the amount of residual, or left over yarn, on the creel at the end of a lot, thus eliminating the need for the cut back operation. Further, when deviation was reduced at each servicing, the distribution of run out times of the bullhorns was narrow. According to computer simulation studies, a narrow distribution of runout times allowed the automated creeler to service the creel faster and more efficiently. Because the automated creeler does not have to travel long distances to find the next empty package to service, there was a high probability of finding a package that needed to be serviced close to the one that was just serviced.

A first computer simulation study investigated the effect that matching package weights had on reducing the amount of residual yarn left on a creel after 12 package replacements. First, 12 sets of 960 numbers randomly chosen from a normal distribution with a mean of 13 pounds and standard deviation of 0.5 pounds were created. These numbers represented an actual carpet tufting operation having a yarn lot size of approximately 100,000 yarns and 960 yarns across the width of the carpet. Each set was classified into 2 (heavy and light), 3 (heavy, medium, light), 4 (heavy, medium, medium light, light), and 5 (very heavy, heavy, medium, light and very light) classes. Categorization of 960 classes was achieved by arranging the data set such that the heaviest package from the first set was matched with the lightest of the next set, the second heaviest package was matched with the second lightest of the next set, and so forth. The 'no class' category represented the random placement of packages without consideration for weight deviation, which is the current placement scheme.

Next, at every even package replacement (second, fourth, etc.), the opposite weight was placed at each bullhorn to minimize the standard deviation of the distribution of yarn weight across the creel. For example, if bullhorn #12 had a heavy package from the first set, then a light package was placed from the next set at the bullhorn. After every replacement, the bullhorn that had the lightest total weight of yarn placed was identified, and the total differences between that minimum value and the total weight run at each bullhorn was calculated. The sum of these differences was termed the total residual yarn and it represents the yarn remaining on the creel after the first package is empty.

FIG. 9 and Table 1 illustrate the total residual yarn after each replacement of packages for a creel with 960 bullhorns. FIG. 9 represents the average of the five experiments. The total residual yarn is plotted against the number of package replacements for six different weight categories. In FIG. 9, the total residual yarns are compared after each replacement. From this Figure, there were several discoveries. First, this Figure shows the expected result of a reduction in total residual yarn by applying a larger number of classes. The second expected result is the zigzag lines, or the fluctuation of total residual yarn, by applying the matching methods. The fluctuation of total residual yarn occurred because the package weight classes at an even number of replacements (second, fourth, etc.) were matched with the odd number of replacements, thus decreasing the residual yarn at each even replacement.

TABLE 1

| Replacements | No classes (lb) | 2 classes (lb) | 3 classes (lb) | 4 classes (lb) | 5 classes (lb) | 960 classes (lb) |
|---|---|---|---|---|---|---|
| 1 | 1422.3 | 1422.3 | 1422.3 | 1422.3 | 1422.3 | 1422.3 |
| 2 | 2093.2 | 1632.1 | 1283.5 | 1227.8 | 1161.7 | 220.5 |
| 3 | 2618.9 | 2122.7 | 2060.1 | 1860.9 | 1890.3 | 1600.2 |
| 4 | 2905.3 | 1935.7 | 1731.0 | 1565.6 | 1731.4 | 245.5 |
| 5 | 3175.9 | 2566.1 | 2421.2 | 2057.2 | 2096.8 | 1574.7 |
| 6 | 3507.6 | 2336.0 | 2052.2 | 1645.3 | 1850.4 | 304.1 |
| 7 | 3779.3 | 2637.3 | 2768.3 | 2337.2 | 2371.1 | 1551.6 |
| 8 | 4208.0 | 2761.0 | 2428.6 | 1914.7 | 1979.1 | 409.6 |
| 9 | 4573.7 | 3024.8 | 3062.0 | 2791.8 | 2662.2 | 1632.8 |
| 10 | 4949.2 | 3165.3 | 2771.4 | 2406.5 | 2262.3 | 443.3 |
| 11 | 5033.2 | 3395.9 | 3259.9 | 2953.0 | 2924.1 | 1645.3 |
| 12 | 5302.6 | 3568.8 | 2971.2 | 2409.5 | 2689.5 | 370.8 |

Evaluating FIG. 9 reveals other findings as well. By applying 2 class matching, a 33% reduction in residual yarn is seen as compared to the matching or random package placement. Reviewing the next three categories shows the reduction in the amount of total residual yarn is about 15% each time the number of classes is increased by one. When 960 classes are applied, the least amount of total residual yarn is observed after 12 replacements as expected. Thus, the amount of total residual yarn decreases as the number of classes are increased. However, increasing the number of classes complicates the logistics of matching. In the case of using 960 classes, a package from one set has only one mate from another set of packages, which means that all 960 packages must be presorted to ensure that the matching mate is identified.

One way to set up the system so that a large number of categories can be used was if the packages were pre-categorized and sorted by the weights before being picked up and serviced by the present invention. This allowed the automated creeling device to load the packages from the heaviest to the lightest classes. Then, the next set of packages were loaded from the lightest to the heaviest classes and the exact order of servicing that was previously used was followed. This simplified the task of finding a mate to match even though there were many weight classifications.

The servicing policies reduced the traveling distance of the present invention. Also, the physical parameters necessary to design the automated creeling device of the present invention were identified and evaluated by simulation study. The simulation program applied the matching method and the servicing policies to investigate how sensitive the system was to changes in device parameters. The results were used to specify the present invention's physical parameters. The servicing policies and the parameters were determined to be successful because the automated creeling devices serviced the creel without ever stopping the tufting machine. The number of devices required, ranges of physical parameters, and feasible creel configurations were identified through the simulation.

FIG. 10 shows a time line generated by the computer simulation. Each block represents the amount of time required to complete each task. Thus, the tasks begin with the loading of the first spools onto the bullhorn (loading A1). Once that task is completed, the tufting machine begins running using those spools of yarn. At the same time, the device begins loading the next set of spools onto the bullhorn (load B1). Parameters in the system were discovered from studying the above simulation data.

The following concepts were used as a guideline for the development of the present automated creeler:

1. The greatest effort should be directed toward improving the service time of the device;
2. When improving the speed of the creeling device, efforts should be concentrated on improving the X-Y directional speed, as long as the Z directional speed is set above 0.25 ft/sec; and
3. The creeling device should carry at least 12 packages.

The success of the above study was measured by the continuous operation of tufting machine.

SUMMARY OF THE INVENTION

Briefly described, in a preferred form, the present invention generally comprises a service arm assembly, a vertical support, a base support, a weighing means and computer control systems. The present invention preferably incorporates an intelligent package loading scheme to minimize yarn waste and creeler travel. Empty package determination is mainly done by computer tracking of running time. The automated creeler travels on tracks, and is equipped with position control systems. The service arm assembly can comprise a service arm equipped with an air bladder device and a four bar linkage mechanism to load packages onto an angled bullhorn.

The present invention also comprises methods of handling a yarn package in conjunction with a creel for the carpet tufting industry. Applications for the present invention are varied, and the device may be used in connection with various applications utilizing creeling devices.

Accordingly, it is an object of the present invention to provide an automated creeling device which will improve working conditions on the manufacturing floor.

It is another object of the present invention is to provide an automated creeling device which will reduce work-related injuries, and its associated costs.

Another object of the present invention is to provide an automated creeling device to reduce operator training costs.

Still another object of the present invention is to provide an automated creeling device to reduce labor and operational costs.

Another object of the present invention is to provide an automated creeling device to increase process efficiency and limit operator errors.

It is another object of the present invention to provide an automated creeling device to improve final product quality.

Yet another object of the present invention is to provide an automated creeling device to reduce yarn waste.

Still another object of the present invention is to provide an automated creeling device which enables an increase in the vertical height of the creel, drastically reducing the floor space used by currently used creels.

These and other objects, features and advantages of the present invention will become more apparent upon reading the following specification in conjunction with the accompanying drawing figures.

DETAILED DESCRIPTION OF A PREFERRED EMBODIMENT

Figure 1:
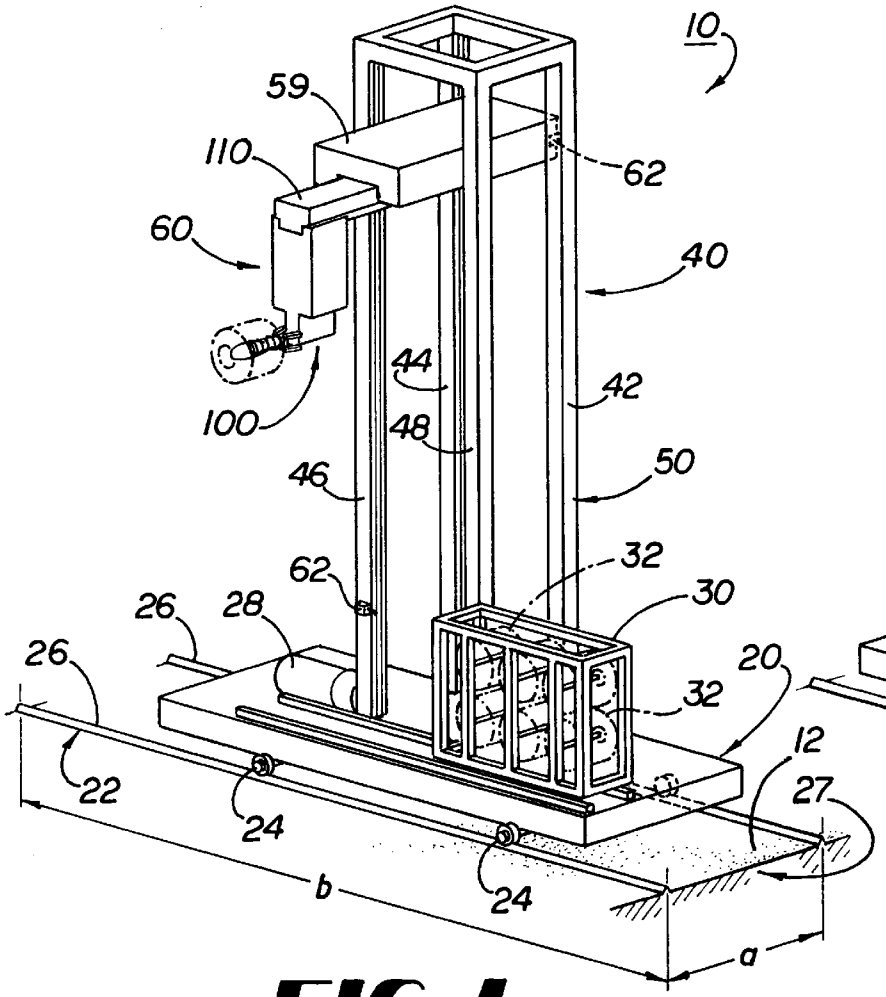
FIG. 1 is a perspective view of an automated yarn creeling device equipped with one service arm according to one embodiment of the present invention.

Referring now in detail to the drawing figures, wherein like reference numerals represent like parts throughout the several views, FIG. 1 shows a perspective view of one embodiment of the present invention.

As shown in FIG. 1, the present invention 10 preferably comprises service arm assembly 60, vertical support 40, base support 20, weighing means 100.

As shown in FIGS. 1–5, the horizontal service arm assembly 60 is designed to grasp both empty and new packages 32, passively allow the packages 32 to rotate so that the core 33 of the packages 32 is in proper alignment with the bullhorn 21, retrieve new packages 32 from a magazine 30 of new packages 32, and discard the core 33 of an empty package removed from a bullhorn 21 into a bin (not shown) attached to the magazine 30. For convenience, the designation of packages 32 may at different times relate both to full packages 32 and empty packages 32 of yarn. To perform the above tasks, the horizontal service arm assembly 60 can comprise a vertical carriage 59, an extension means 110, a linkage assembly 70, and a grasper 80.

Figure 3:
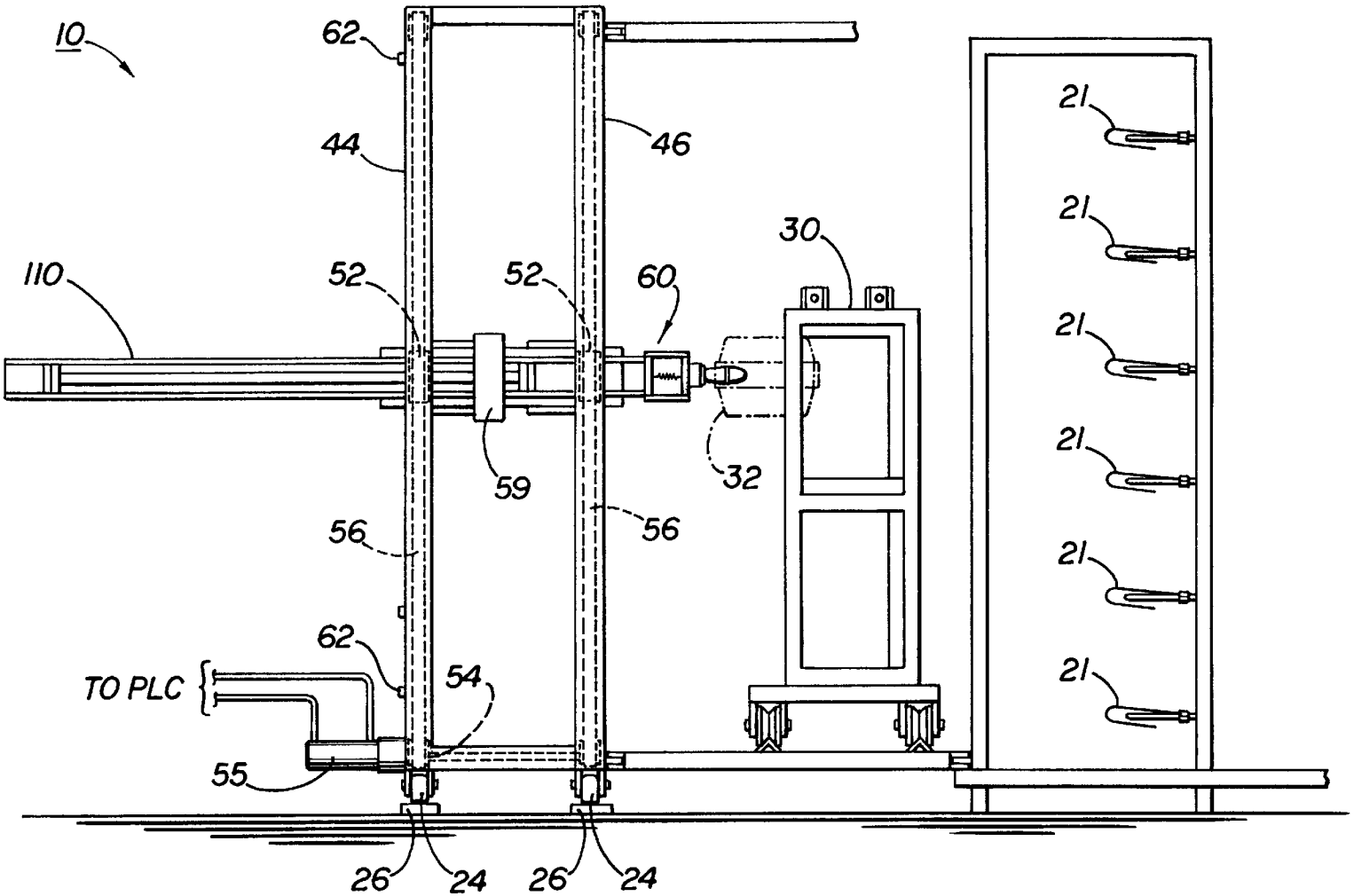
FIG. 3 is a side view of an automated yarn creeling device according to another embodiment of the present invention.

The vertical carriage 59 is the structure enabling the service arm assembly 60 to move vertically. As shown in FIG. 3, a timing belt 56 may drive the vertical carriage 59 which has, in one embodiment, 1600 mm of vertical travel. Bearings 52 support the horizontal service arm assembly 60 and are carried by the vertical carriage 59. Further, limit stops 62 may be provided at the ends of travel of the vertical carriage 59.

In one embodiment of the present invention, the vertical carriage 59 is driven by an Allen Bradley 1326DS DC Servo Motor with a 20:1 ratio, planetary gear box. A spring-set, electric-release break may also be provided. The Servo Motor is powered by an Allen Bradley Servo amplifier. It should be understood that references to specific and/or brandname components are only for illustration of function and as examples.

The horizontal service arm assembly 60 may further comprise extension means 110 as shown in FIG. 3 which extends and retracts the horizontal service arm assembly 60 in the horizontal plane. In one embodiment, extension means 110 is a Bimba rodless pneumatic cylinder. Controls may be provided to enable the rodless cylinder to stop at designated positions along its stroke. A three-position, five-port, spool valve with blocked center ports controls the direction of motion and stops the Bimba cylinder. Two-position, three-port spool valves control the speed of the cylinder by selecting one of two exhaust flow restrictions. One is provided in each direction of motion. Sensors, for example Seven Hall-effect sensors, can be provided along the stroke of the cylinder detect the extended positions of the cylinder piston. In another embodiment, extension means 110 may extend and retract the horizontal service arm assembly 60 in the horizontal plane by means of a telescoping assembly. In a further embodiment, extension means 110 may use electric means instead of pneumatic means to extend and retract.

Figure 4:
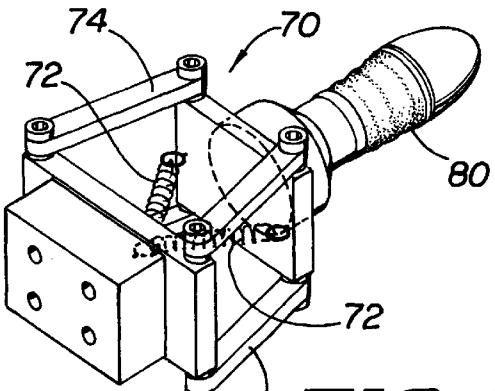
FIG. 4 is a perspective view of one service arm assembly of the present invention.

The arm assembly 60 may further comprise linkage assembly 70, shown in FIG. 4, which enables a package 32 to rotate several degrees in the horizontal plane so that a package 32 may align itself with varying horizontal angles of the bullhorn 21. Biasing springs 72 can be used to center the linkage assembly 70 once the package 32 has been placed upon the bullhorn 21. The linkage assembly 70 may be a four bar linkage mechanism 74 to allow the package 32 to rotate as much as 17 degrees, and more if necessary, to align itself with the angle of the bullhorn 21, as some creels have bullhorn angles of 17 degrees from perpendicular.

Figure 5:
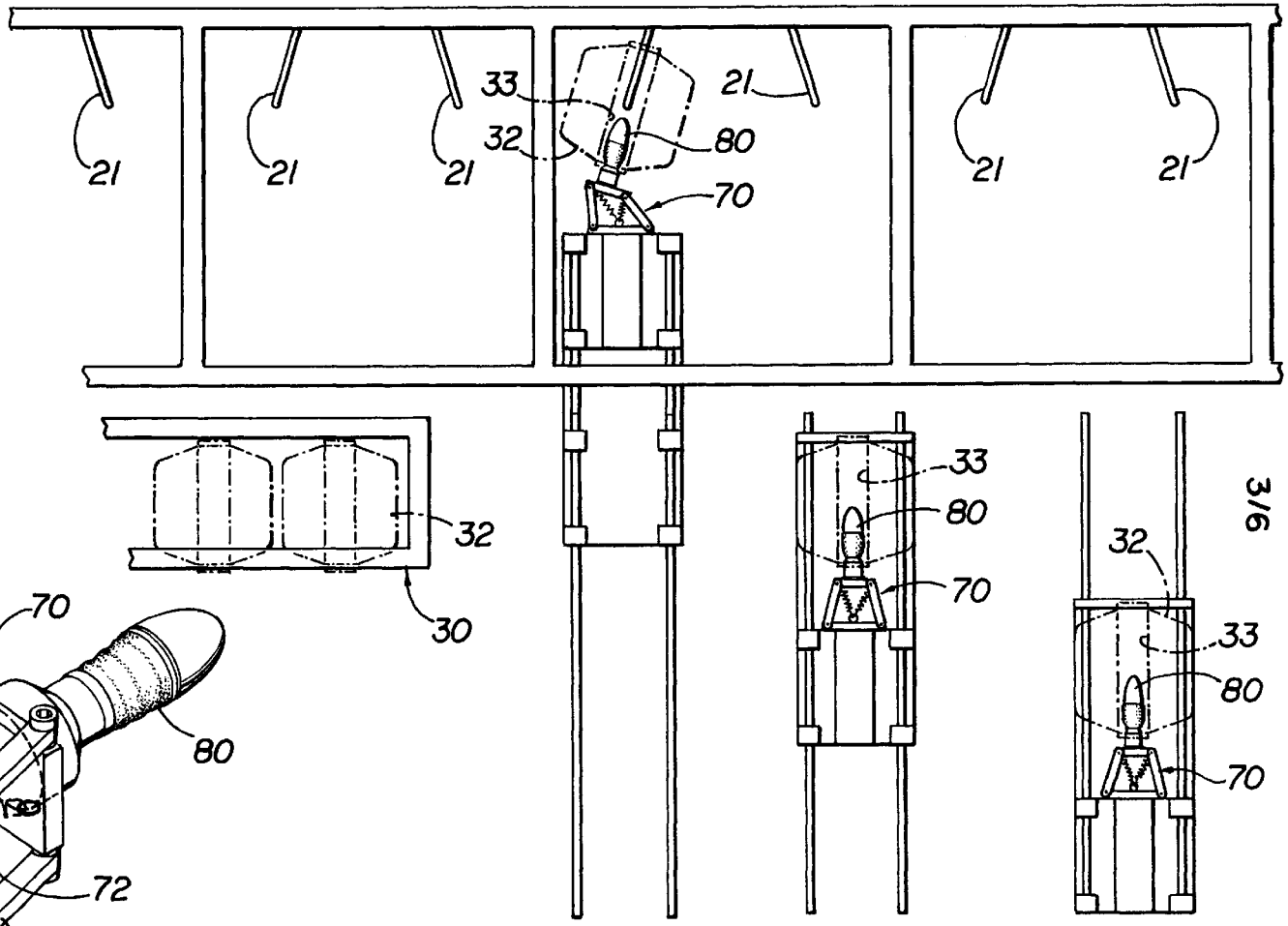
FIG. 5 is a top view of the service arm assembly shown in FIG. 1.

The horizontal service arm assembly 60 may further comprise a grasper 80 used to grasp the package 32 from the core 33 of the packages 32 as shown in FIGS. 4 and 5. In a preferred form, the grasper 80 comprises an inflatable bladder or "air picker" 80, so that upon filling the bladder with air, the core 33 of the package 32 is releasably secured to the air picker 80.

In one embodiment, the grasper 80 comprises a Bridgestone air picker to grasp the package 32 from the inside of the package using tube or core 33 with an inflatable bladder. This eliminates the risk of yarn contamination from handling the package 32 by the yarn surface. In another embodiment, a rocket head can be added to the end of the grasper 80 to allow it to be used to unload empty cores 33 from the bullhorns 21. In this embodiment, an aluminum cone (not shown), is attached to the end of the air picker 80 and helps guide the air picker 80 into the inside of the core 33 of an empty package 32 during removal.

In another embodiment of the present invention, the grasper 80 may include an identification means to identify characteristics of each package. For example, the identification means can comprise a bar code reader (not shown). A bar code reader is capable of reading and identifying a bar code label located on the core 33 of a package 32. The bar which code can provide information such as yarn lot number, shipping weight of the package 32, and other information.

The present invention can further comprise vertical support 40. Vertical support 40 provides a structure enabling the service arm assembly 60 to move vertically, and may take several forms. In one embodiment, vertical support 40 can comprise a main structure 50, incorporating four columns 42, 44, 46, 48, vertical linear bearings 52, and vertical timing belt drives 54 and belts 56. A gear motor 55 at the base of one of the columns, preferably column 42, drives a timing belt 56 on each column.

The automated creeler may further comprise a base support 20 that is generally rectangular in shape having dimensions a and b wherein length b is longer than width a, as shown in FIG. 1. Base support 20 is of a size, shape, and strength to move smoothly through the aisles between creels, to carry new packages 32 without interference with the present invention's servicing abilities, and to support the present invention off the floor. Base support 20 is ultimately supported by the floor 12 through a movement means 27. In one embodiment, the movement means 27 comprises a wheel and track assembly 22, incorporating a plurality of wheels 24, tracks 26 and motor 28. The movement means 27 moves and guides the automated creeling device 10 in the aisle along the creel between tufting machines (not shown). In a preferred embodiment, the automated yarn creeling device 10 moves in the aisle using a combination of angle iron track 26 and four V-grooved wheels 24. It will be obvious to one skilled in the art that movement means 27 may comprise many designs which will enable the present invention to travel along the creel.

Figure 2:
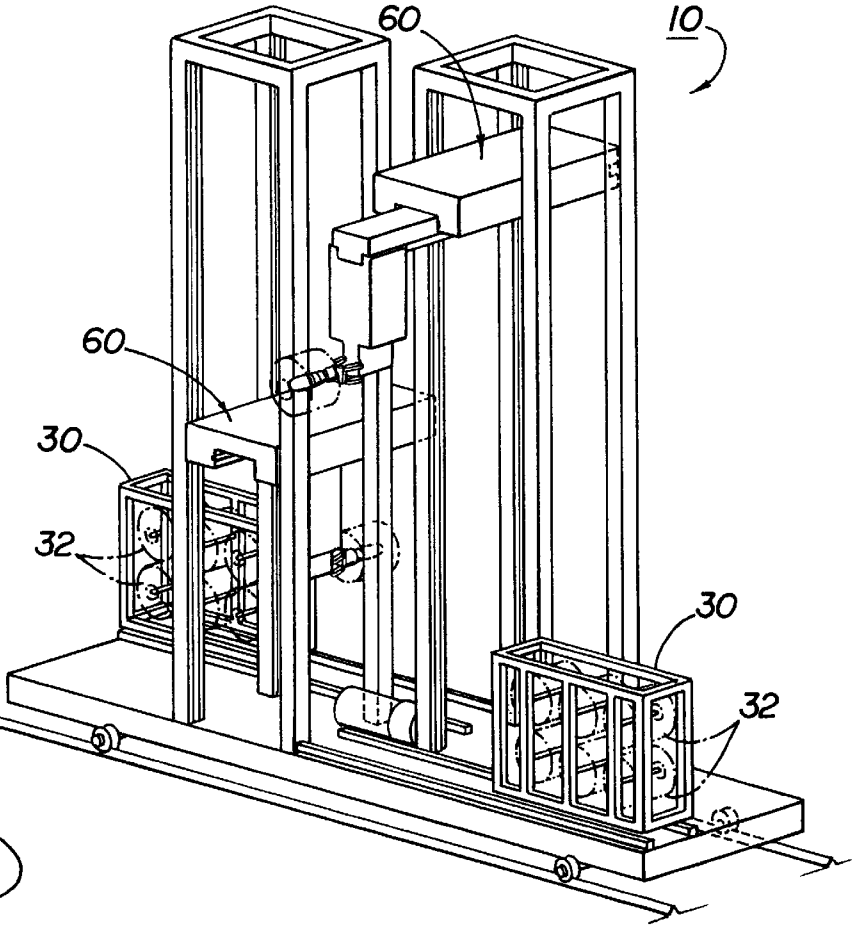
FIG. 2 is a perspective view of an automated yarn creeling device equipped with two service arms according to another embodiment of the present invention.

The base support 20 may further include a yarn package magazine 30 used to hold full packages 32 of yarn. Preferably, the present invention comprises one magazine 30 per each service arm assembly 60. As shown in FIG. 2, in another embodiment of the present invention, automated creeling device 10 may comprise two service arm assemblies 60, wherein in this embodiment, the automated creeling device 10 can service both sides of the aisle between tufting machines, and therefore, has two magazines 30 of full packages 32 of yarn. Each magazine 30 generally holds one layer of yarn packages 32 from the shipping carton. Magazine 30 is further capable of positioning in front of service arm assembly 60 so that assembly 60 moves minimally to retrieve a full package 32 to load on the next bullhorn 21. For example, such movement may incorporate the use of a pneumatic cylinder.

The present invention can also comprise weighing means 100 which weighs a package 32 releasably attached to the grasper 80 before it is placed on the bullhorn 21, as shown in FIGS. 1–5. This allows a sort-by-weight assignment to be used. In one embodiment, the weighing means 100 comprises an Assurance Technologies six-axis-force-and-torque transducer (for example, model F15/T50) to weigh the package 32 on the end of the grasper 80. However, a single axis transducer can be suitable.

The present invention can further comprise controller means to control the device. For example, the controller means of the present invention can be based on an Allen Bradley SLC 500 PLC with a 10-slot chassis. A number of discrete Input and Output modules are installed. In addition, a single IMC 110, single-axis motion control module is installed. The motion control module generates an analog signal to motor amplifier based on a control law, position and velocity feedback from the optical encoder on the motor, and commands passed from the SLC 500 PLC. The machine operation is controlled by a ladder-logic program running on the SLC 500 PLC. The program observes all of the switch settings and generates the necessary sequence of output and motor commands.

Further, the position signals from Hall-effect sensors comprising the extension means 110, are used by the controller means to achieve the various horizontal positions of the service arm assembly 60.

Operation

Operation of the automated creel device 10 ultimately transfers packages 32 of yarn from shipping pallets to the bullhorns 21. The present invention can determine the location of empty packages 32, remove the empty packages 32, discards the empty cores 33, weigh the full packages 32, and intelligently place the full packages 32 on the bullhorn 21.

Figure 6:
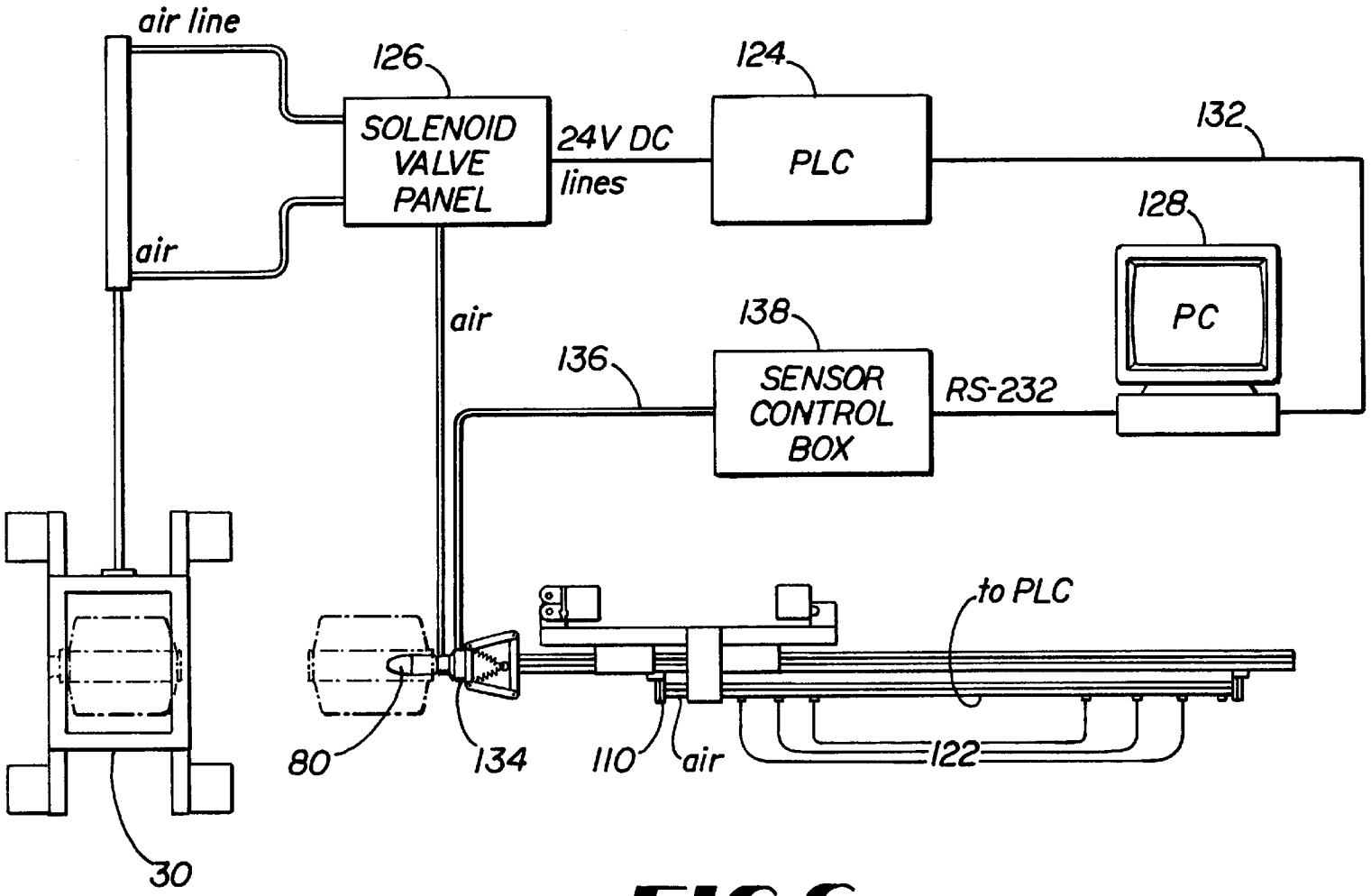
FIG. 6 is a block diagram of controlling systems of the device of FIG. 3.

FIG. 6 is a block diagram of one embodiment of the present invention. Extension means 110, a rodless air cylinder, extends the assembly 60 back and forth horizontally. There are seven Hall-effect sensors 122 that sense a stationary magnet as they pass it. As each sensor passes the magnet, it sends a signal to the control means (PLC) 124. From the sensors' signals, the control means 124 controls the position of the extension means 110 and sends signals to solenoid air valves 126 that control the rodless air cylinder's speed and direction. A solenoid valve also controls the position of the magazine 30 that holds the spools 32. Another solenoid valve sends air to the air picker to inflate and deflate it.

After the arm assembly 60 has removed a package 32 from the magazine 30, the PLC 124 informs the PC 128 by sending a signal to the PC across a DH-485 (network) cable 132. When the PC 128 receives this signal it commands the force/torque sensor 134 of the weighing means 100 to weigh the package 32 by sending a signal to the sensor's control box across an RS-232 serial cable 136.

Figure 7:
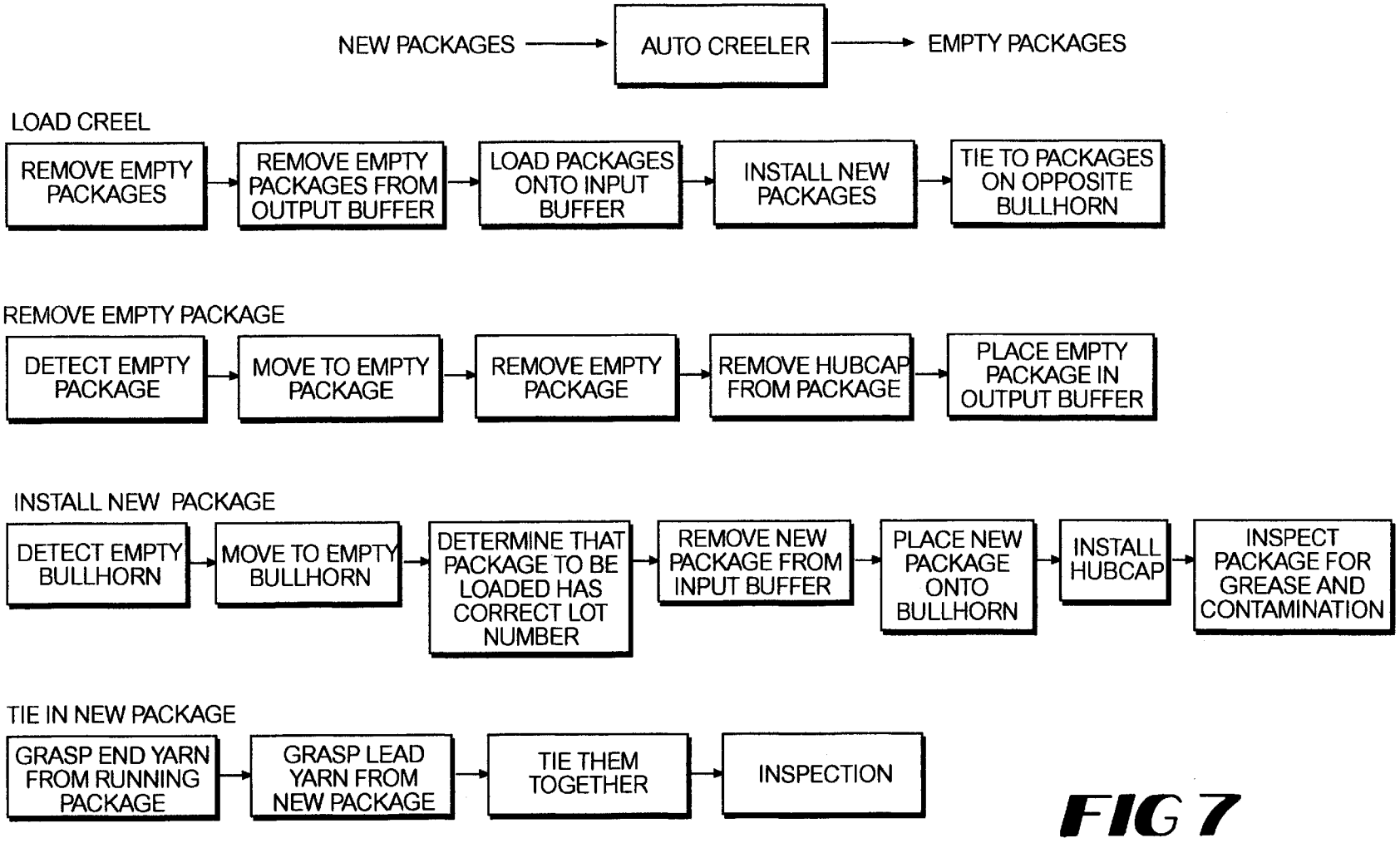
FIG. 7 is a flow chart of normal operation of the creel.
Figure 8:
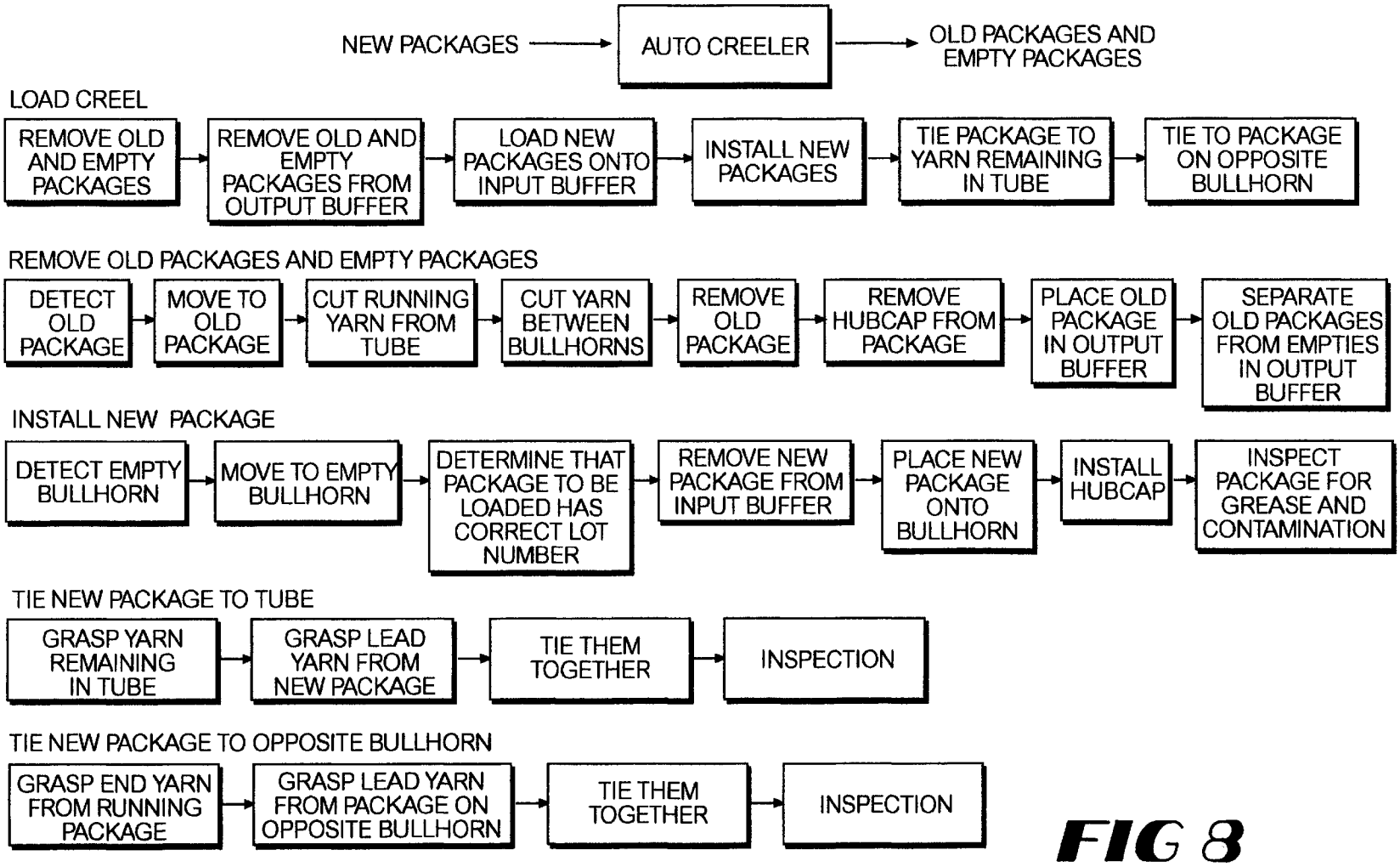
FIG. 8 is a flow chart of the creel's normal operation and change over operation.
Figure 9:
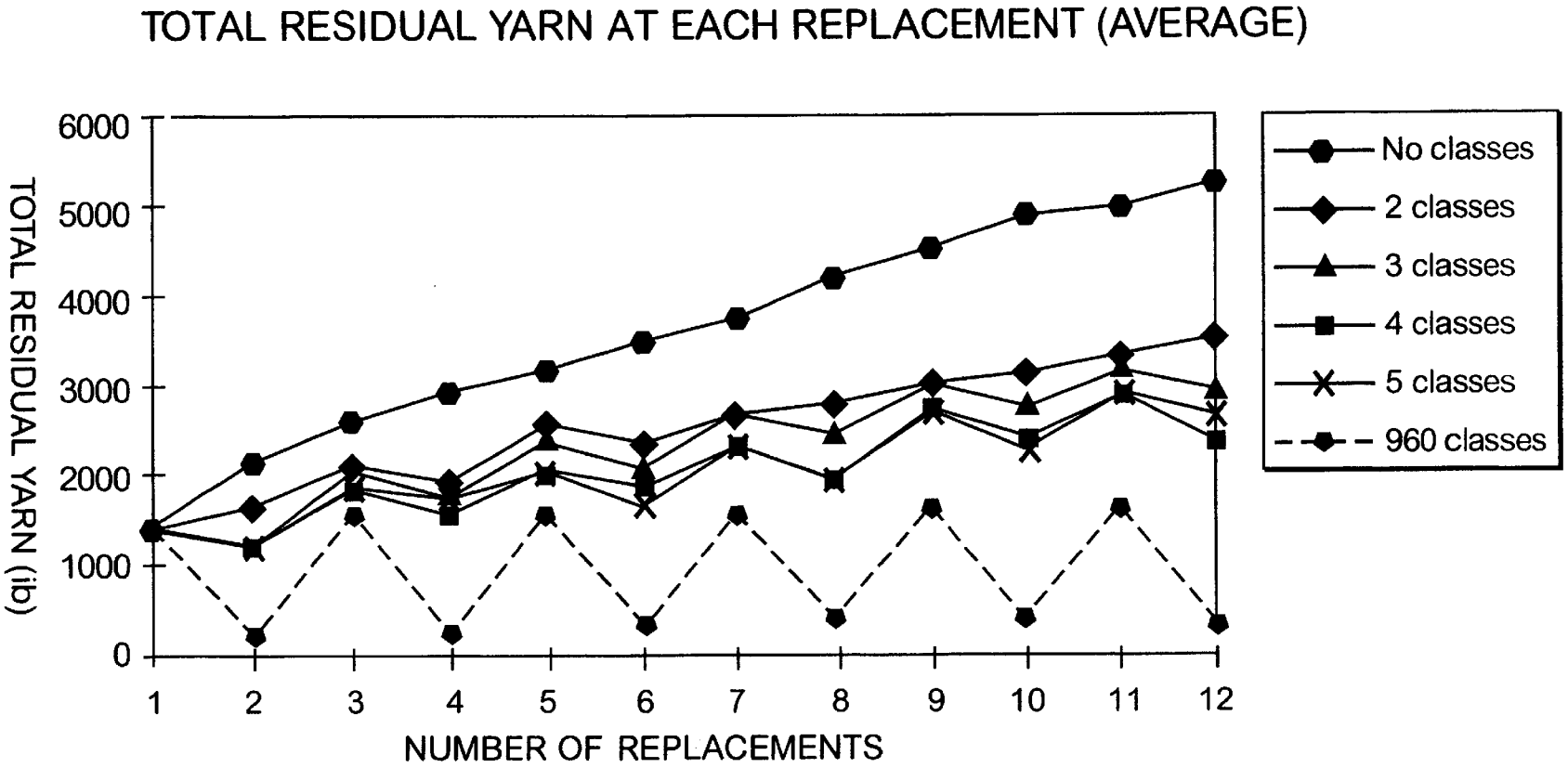
FIG. 9 illustrates the total residual yarn after each replacement of packages for a creel with 960 bullhorns.
Figure 10:
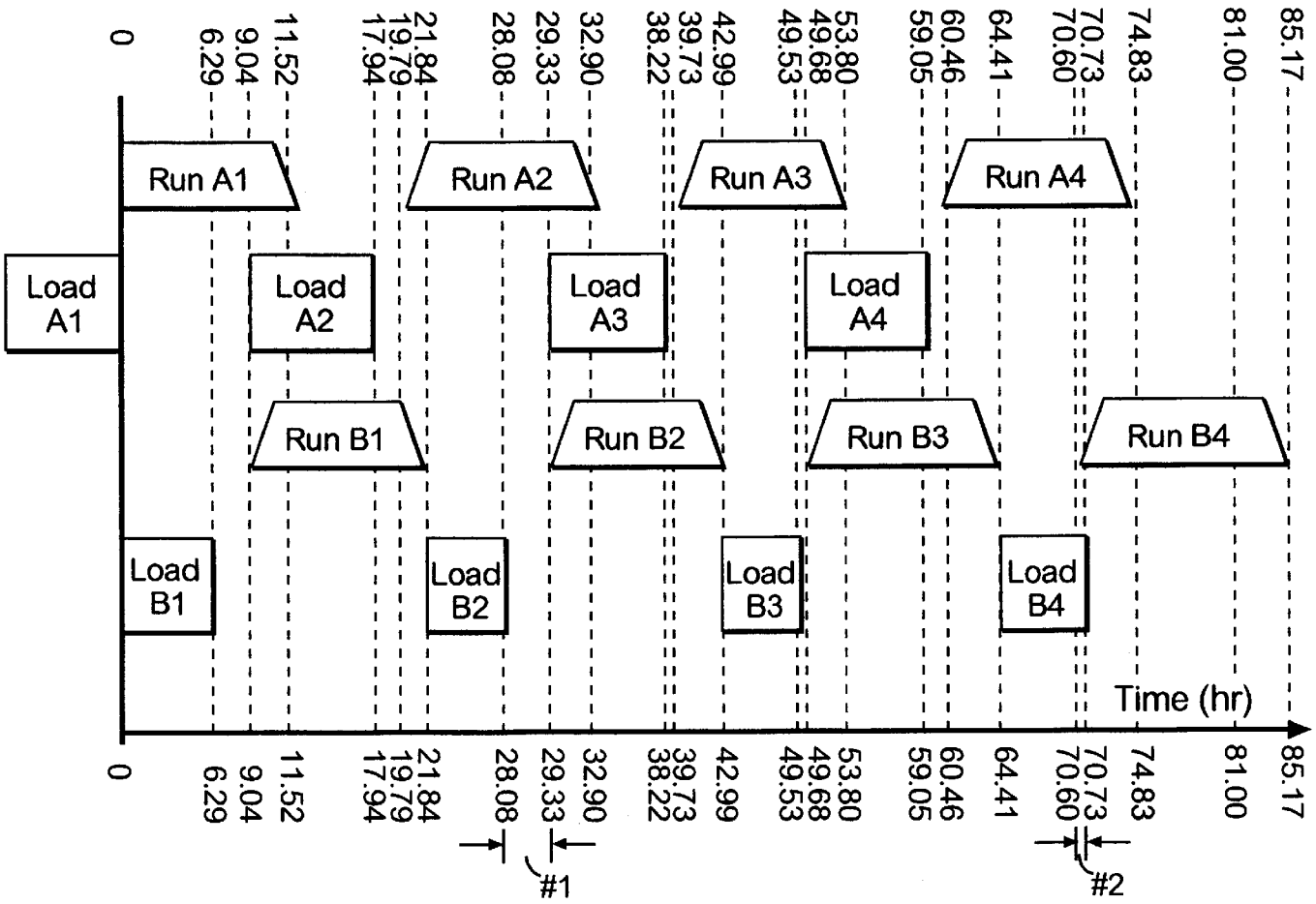
FIG. 10 shows a time line generated by the computer simulation.

The force/torque sensor 134 weighs the package 32, and the sensor control box 138 then reports the package's weight back to the PC 128. The PC 128 then determines which bullhorn 21 the package 32 should be placed on, based on it's weight, and sends a corresponding number between 1 and 5 back to the control means. The PLC 124 then commands the servo-motor (not shown) to lift the service arm to the same height as the bullhorn to be loaded. Once at the right height, a solenoid valve sends air to the front side of the rodless air cylinder 110, extending it forward. The two modes of operation that the present invention automates in the creeling process are: (1) the normal operation, as shown in flow chart form in FIG. 7 and (2) changeover operation, as shown in flow chart form in FIG. 8.

As shown in FIGS. 3–8, the automated creeling device 10 first determines the location of a bullhorn 21 supporting an empty package 32 of yarn. Then by movement means 27, the present invention moves down the aisle of a creel to the empty package 32 to be replaced. The service arm assembly 60 extends horizontally and, using grasper 80, slides into core 33 of the empty package. The grasper 80 then inflates to securedly attach the core 33 of the empty package 32 to the grasper 80. The horizontal service arm assembly 60 retracts horizontally away from bullhorn 21, deflates the inflatable bladder, and discards empty core 33 in an appropriate container (not shown).

Service arm assembly 60 then adjusts to grasp a new package 32 from magazine 30 for placement on the creel. Upon securing new package 32 via grasper 80, the empty bullhorn 21 is fitted with new package 32 about core 33. As the horizontal service arm assembly 60 extends to meet bullhorn 21, linkage assembly 70 allows the package 32 to passively rotate in the horizontal plane to align itself with the angle of the bullhorn 21. This passive rotation is caused by the forces from the bullhorn 21 acting on the package 32, as well as the grasper 80 acting on the package 32, while service arm assembly 60 continues to extend.

The location of replaced new package 32, and the weight of new package 32, both are processed by the controller means. When the automated creeler places a package 32 on a bullhorn 21, a computer keeps track of which bullhorn 21 the package 32 was placed on, the weight of the package 32, and the time it was placed on the bullhorn 21. From the weight of the package 32 and the speed of the tufting machine, the computer can estimate how long it will take for the package 32 to run out. The constant replacement and weighing of packages 32 by the automated creeling device 10 enables the present invention to efficiently monitor and replace empty packages 32 of yarn.

Although the present invention has been described with reference to preferred embodiments, it will be apparent to those skilled in the art that variations and modifications of the present invention are within the spirit and scope of the present invention.

What is claimed is:

1. An automated service arm assembly for loading and unloading articles from a system of canted article holders, the articles having a proximal end being proximal to the service arm assembly and a distal end being distal from the service arm assembly said assembly comprising:

a. a carriage to raise and lower the service arm assembly vertically;

b. an extension device to extend and retract the service arm assembly horizontally;

c. a linkage assembly to passively maneuver the articles on and off the canted article holders; and d. a grasper to grasp the articles;

the service arm assembly being capable of loading and unloading randomly located canted article holders.

2. The service arm assembly of claim 1 further comprising a weighing device to weigh the articles, and said linkage assembly having a center of compliance nearer the proximal ends of the grasped articles than the distal ends.

3. The service arm assembly of claim 1, wherein said extension means is a pneumatic cylinder, said grasper is an inflatable bladder and the automated service arm assembly is for a tufting machine with a magazine creel where single articles can be loaded and unloaded during the continuous running of the tufting machine.

4. The service arm assembly of claim 1, wherein said linkage assembly enables said grasper to rotate the articles several degrees so that the articles may align themselves with the angle of the canted article holders.

5. The service arm assembly of claim 1 further comprising an identification device to identify characteristics of each article.

6. An automated device for loading and unloading an article from a canted article holder, said device comprising:

a. a service arm assembly including a carriage to raise and lower said service arm assembly vertically, an extension device to extend and retract said service arm assembly horizontally, a linkage assembly to passively maneuver the article on and off the canted article holder, and a grasper to grasp the article; and b. a vertical support providing a vertical structure upon which said carriage can ride to raise and lower said service arm assembly;

the service arm assembly loading and unloading one article at a time.

7. The device of claim 6 further comprising:

a. a base support supporting said vertical support above a floor under the article holders; and b. a movement device to move the automated loading and unloading device across the floor.

8. The device of claim 7 further comprising:

a. a computer control system to control the device automatically;

b. a weighing device to weigh the articles; and c. an identification device to identify characteristics of each article, said identification device incorporating a bar code reader.

9. A method of handling yarn packages having a core on and off canted bullhorns of a creel comprising the steps of:

a. detecting an empty package of yarn on a first canted bullhorn;

b. removing the empty package from the first canted bullhorn;

c. selecting a new package from a magazine of new packages;

d. identifying the weight of the new package;

e. determining a second canted bullhorn upon which to place the new package utilizing location data of the second canted bullhorn and weight data of both the empty and new packages:

f. placing the new package on the second bullhorn.

10. The method of handling yarn packages according to claim 8, wherein said steps are carried out by an automated creeling device having a linkage assembly capable of passively maneuvering packages on and off the canted bullhorns.

11. An automated creeling device for monitoring and replacing packages of varying weights on and off canted bullhorns of a creel associated with a textile machine, said creeling device comprising:

a. a service arm assembly including a linkage assembly capable of passively maneuvering packages on and off the canted bullhorns; and b. an automated system capable of utilizing data related to the weight and location of packages in order to identify individual packages for replacement off the canted bullhorns, said automated system capable of intelligently matching lighter weight packages with heavier weight packages;

the automated creeling device capable of replacing packages on and off randomly located canted bullhorns during the continuous operation of the textile machine.

12. The creeling device of claim 11, wherein said service arm assembly further comprises:

a. a carriage capable of raising and lowering said service arm assembly vertically;

b. an extender capable of extending and retracting said service arm assembly horizontally;

c. a grasper to grasp the packages.

13. The creeling device of claim 11, wherein said linkage assembly consists of a four-bar linkage.

14. The creeling device of claim 11, wherein said linkage assembly enables a grasper capable of grasping packages to rotate a package several degrees so that the package may align itself with the canted bullhorn.

15. The device of claim 11 further comprising an identifier capable of identifying characteristics of each package.

16. The device of claim 15 wherein said identifier is a bar code reader.

17. The device of claim 11 further comprising a weigher capable of weighing packages, and wherein the packages are packages of yarn.

18. The device of claim 17 wherein said automated system is capable of associating lighter weight packages of yarn with heavier weight packages of yarn, such that all the packages of yarn run out at approximately the same time at the conclusion of a yarn lot.

19. The device of claim 17 wherein said automated system is capable of utilizing additional data related to the time of placements of packages, sizes of yarn packages, and the speed of the tufting machine running the packages in order to identify individual packages for replacement off the canted bullhorns, said automated system capable of intelligently associating lighter weight packages with heavier weight packages.

* * * * *